US006382346B2

(12) United States Patent
Brimhall et al.

(10) Patent No.: US 6,382,346 B2
(45) Date of Patent: May 7, 2002

(54) RETENTION AND EXTRACTION DEVICE FOR A HEARING AID

(75) Inventors: Owen D. Brimhall, South Jordan; Jerry L. Pauley; Carl E. Ellis, both of Salt Lake City, all of UT (US)

(73) Assignee: Sonic innovations, Salt Lake City, UT (US)

( * ) Notice: Subject to any disclaimer, the term of this patent is extended or adjusted under 35 U.S.C. 154(b) by 0 days.

(21) Appl. No.: 09/768,862

(22) Filed: Jan. 23, 2001

Related U.S. Application Data

(63) Continuation of application No. 09/409,793, filed on Sep. 30, 1999, now Pat. No. 6,179,085.

(51) Int. Cl.[7] ..... E61B 7/02
(52) U.S. Cl. ..... 181/135; 381/328
(58) Field of Search ..... 181/130, 135; 381/322, 324, 328, 329; 128/864, 865, 867

(56) References Cited

U.S. PATENT DOCUMENTS

| | | | | |
|---|---|---|---|---|
| 3,665,122 | A | 5/1972 | Weiss | |
| 4,375,016 | A | 2/1983 | Harada | |
| 4,553,627 | A | 11/1985 | Gastmeier et al. | |
| 4,569,812 | A | 2/1986 | Werwath et al. | |
| 4,756,312 | A | 7/1988 | Epley | |
| 4,869,339 | A | 9/1989 | Barton | 181/135 |
| 4,879,750 | A | 11/1989 | Nassler | |
| 4,880,076 | A | 11/1989 | Ahlberg et al. | |
| 4,937,876 | A | 6/1990 | Biërmans | |
| 5,002,151 | A | 3/1991 | Oliveira et al. | |
| 5,031,219 | A | 7/1991 | Ward et al. | |
| 5,084,224 | A | 1/1992 | Watters | |
| 5,099,947 | A | 3/1992 | Guggenberger et al. | |
| 5,105,904 | A | 4/1992 | Olsen | |
| 5,166,659 | A | 11/1992 | Navarro | |
| 5,201,007 | A | 4/1993 | Ward et al. | |
| 5,203,352 | A | 4/1993 | Gardner, Jr. | |
| 5,293,008 | A | 3/1994 | Danielsen | |
| 5,295,191 | A | 3/1994 | Van Vroenhoven | |
| 5,327,500 | A | 7/1994 | Campbell | |
| 5,395,168 | A | 3/1995 | Leenen | |
| 5,401,920 | A | 3/1995 | Oliveira | |
| 5,440,082 | A | 8/1995 | Claes | |
| 5,654,530 | A | 8/1997 | Sauer et al. | 181/135 |
| 5,682,020 | A | 10/1997 | Oliveira | |
| 5,701,348 | A | 12/1997 | Shennib et al. | |
| 5,748,743 | A | 5/1998 | Weeks | 381/324 |
| 5,835,606 | A | 11/1998 | Marie et al. | |
| 5,875,254 | A | 2/1999 | Hanright | |
| 5,881,159 | A | 3/1999 | Aceti et al. | |
| 5,920,636 | A | 7/1999 | Oliveira et al. | |
| 5,979,589 | A | 11/1999 | Aceti | 181/135 |
| 5,996,584 | A | 12/1999 | Oliveira et al. | |

*Primary Examiner*—Khanh Dang
(74) *Attorney, Agent, or Firm*—Lyon & Lyon LLP

(57) ABSTRACT

A hearing aid retention and extraction device comprises a retention ring having an outer bonding surface and an inner grasping surface, and an elongate member extending from the retention ring. The retention and extraction device can be incorporated into a hearing device tip and allows both a hearing device and the hearing device tip to be simultaneously removed from an ear canal. When a user pulls on the elongate member, the retention ring cinches around the hearing device and prevents it from becoming separated from the hearing device tip. The cinching action of the retention ring also holds the hearing device in place within the ear canal.

14 Claims, 2 Drawing Sheets

RETENTION AND EXTRACTION DEVICE FOR A HEARING AID

RELATED APPLICATION DATA

This application is a continuation of patent application Ser. No. 09/409,793, filed on Sep. 30, 1999, now U.S. Pat. No. 6,179,085.

FIELD OF THE INVENTION

The present invention pertains to hearing aids. More particularly, the present invention pertains to devices for retaining and extracting hearing aids.

BACKGROUND OF THE INVENTION

The modern trend in the design and implementation of hearing devices is focusing to a large extent on reducing the physical size of the hearing device. Miniaturization of hearing device components is becoming increasingly feasible with rapid technological advances in the fields of power supplies, sound processing electronics and micromechanics. The demand for smaller and less conspicuous hearing devices continues to increase as a larger portion of our population ages and faces hearing loss. Those who face hearing loss also encounter the accompanying desire to avoid the stigma and self consciousness associated with this condition. As a result, smaller hearing devices which are cosmetically less visible are increasingly sought after.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices rarely use this Behind-The-Ear technique, focusing primarily on one of several forms of an In-The-Canal hearing device. Three main types of In-The-Canal hearing devices are routinely offered by audiologists and physicians. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. As the name implicates, these devices fit deep within the ear canal and are essentially hidden from view from the outside.

In addition to the obvious cosmetic advantages these types of in-the-canal devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

The shape and structure (morphology) of the ear canal varies from person to person. However, certain characteristics are common to all individuals. When viewed in the transverse plane, the path of the ear canal is extremely irregular, having several sharp bends and curves. It is these inherent structural characteristics that create problems for the acoustic scientist and the hearing device designer.

For general discussion purposes, the ear canal can be broken into three main segments. The external and medial segments are both surrounded by a relatively soft cartilaginous tissue. The external segment is largely visible from the outside and represents the largest cavity of the ear canal. The innermost segment of the ear canal, closest to the tympanic membrane, is surrounded by a denser bony material and is covered with only a thin layer of soft tissue. The presence of this bony material allows for little expansion to occur in this region compared with the cartilaginous regions of the ear canal. In addition to being surrounded by cartilage rather than bone, these areas are covered with a substantially thicker tissue layer. Since there is less cushion, pressure exerted by a hearing device on the inner bony region of the canal can lead to discomfort and/or pain, especially when a deep insertion technique is used.

Since the morphology of the ear canal varies so greatly from person to person, hearing aid manufacturers and audiologists use custom manufactured devices in order to precisely fit the dimensions of a user's ear canal. This frequently requires impressions of the user's ear canal to be taken. The resulting mold is then used to fabricate a rigid hearing device shell. This process is both expensive and time consuming and the resulting rigid device shell does not perform well during the deformations of the ear canal that occur during normal jaw movement. In order to receive a properly fit hearing device, the user typically has to make several trips to the audiologist for reshaping and resizing. Even after the best possible fit is obtained, the rigid shell rarely provides comfortable hearing enhancement at all times.

Because the resulting hearing aid device shell is typically formed from a hard acrylic material, discomfort to the user is increased when worn for extended periods of time. The inability of the hard shell to conform to normal ear canal deformations can cause it to become easily dislodged from its proper position. Consequently, the quality of the hearing enhancement suffers. Furthermore, due to the added manufacturing costs, it is desirable to utilize a hearing device that is at least partially formed from an off-the-shelf or preformed component readily available to the audiologist or physician.

While the performance of CIC hearing devices are generally superior to other larger and less sophisticated devices, several problems remain. Complications typically arise due to the small size of CIC hearing devices and the depth that they are inserted into a user's ear canal.

Because a CIC hearing device forms an essentially air tight seal between the tip of the hearing device and the walls of the ear canal, discomfort to a user is common. In particular, this acoustic seal prevents the equalization of pressure between the internal chamber formed between the tympanic membrane and the hearing device, and the ambient environment. Due to the sensitivity of the tympanic membrane, even small pressure differentials can cause severe discomfort.

Due to their small size and positioning within the ear canal, CIC hearing devices can cause handling problems, making insertion and removal by a user difficult and cumbersome and often lead to damage to the hearing device. In larger, BTE, or ITC hearing devices, the size of the device makes it unnecessary to incorporate a retrieval mechanism into its structure, i.e., the wearer normally will not have any difficulty grasping the device in order to remove it. But in smaller hearing devices, such as a CIC device, retrieval cords and other extraction tools become a necessary addition in order to allow for easy and safe removal by the wearer.

U.S. Pat. No. 5,701,348, entitled "Articulated Hearing Device" ("the '348 patent"), discloses a segmented hearing device with several articulating and non-contiguous parts. The hearing device disclosed in the '348 patent includes a rigid receiver module with a surrounding acoustic seal. The acoustic seal formed by the hearing device disclosed '348 patent includes a sheathing made from a singular piece of foam or silicone which compresses when inserted into the deep regions of an ear canal. The '348 patent also describes the use of this sealing mechanism as an anchor so that the remaining articulating components of the hearing device can move freely and adjust to the changing morphology of the ear canal. While generally conforming to the shape of an ear canal, the hearing device disclosed in the '348 patent still presents comfort problems during insertion and removal due to the single piece construction of its sealing mechanism. Also, due to the single piece construction, the quality of the acoustic seal degrades over time and during prolonged use. Further, the ability to effectively interchange and clean the sealing material is also compromised. In particular, the device disclosed in the '348 patent is not conducive to use with a CIC hearing device, where the acoustic seal is the only point of contact with the ear canal. Compression of the sealing material reduces the volume of the foam and the sealing properties are accordingly diminished.

U.S. Pat. No. 5,395,168, entitled "In the Ear Hearing Aid Having Extraction Tube Which Reduces Acoustic Feedback" ("the '168 patent"), discloses an in-the-ear hearing device, which incorporates a retrieval system mechanically attached to the hearing device body. The retrieval cord is also presented as a hollow acoustic tube to aid in reducing acoustic feedback. In order to reduce acoustic feedback, the acoustic tube disclosed in the '168 patent extends into the receiver housing and engages with the receiver elements. While aiding in the reduction of acoustic interference, this device also presents comfort problems during insertion and removal due to the lack of a venting or pressure equalization system between the inner chamber formed by the hearing device, and the ambient environment.

U.S. Pat. No. 4,880,076, entitled "Hearing Aid Ear Piece Having Disposable Compressible Polymeric Foam Sleeve" ("the '076 patent"), discloses a disposable sleeve that is secured to the ear piece of a hearing aid. The sleeve includes a plastic duct which is fitted with a threaded connection for attachment to the hearing aid ear piece. A soft polymeric foam piece is placed over the sleeve. While the duct disclosed in the '076 patent does provide venting capabilities, the rigid structure and threaded or snap connections add significant size to the hearing aid tip. In particular, the device disclosed in the '076 patent still requires a separate retrieval cord for smaller hearing aid tips. Even though the duct and foam covered sleeve are soft and flexible, the threaded connectors are not, and contribute to an overall lack of flexibility of the device.

SUMMARY OF THE INVENTION

In accordance with a first aspect of the invention, a hearing aid retention and extraction device is provided, which comprises a retention ring and an elongate member extending from the retention ring. The hearing aid retention and extraction device is adapted so that the retention ring can be incorporated into a hearing device tip. A receiver module of a hearing device can be inserted into the hearing device tip and at least partially through the retention ring of the hearing aid retention and extraction device.

In a preferred embodiment, the retention ring cinches around the receiver module of the hearing device and holds it in place during use. By pulling on the elongate member extending from the retention ring, a user can easily remove both the hearing device and the hearing device tip from the ear canal. Pulling on the elongate member causes the retention ring to further cinch around the hearing device, thereby preventing the device from becoming separated from the tip. The hearing device retention and extraction device can be either bonded by adhesive to the hearing device tip, or it can be incorporated directly into the structure of the tip. A hearing device retention and extraction device constructed in accordance with the present invention can be adapted for use with all varieties of in-the-canal hearing devices, including completely in-the-canal hearing devices.

In accordance with another aspect of the invention, a hearing device is provided, which comprises a receiver module, a conformal tip adapted to engage with the receiver module, and a retention and extraction device attached to the inside surface of the conformal tip.

In accordance with a further aspect of the invention, a hearing device tip is provided, which comprises a conformal sheath and a hearing aid retention and extraction device attached to the conformal sheath. Other and further aspects and advantages of the invention will become apparent hereinafter.

BRIEF DESCRIPTION OF THE DRAWINGS

The drawings illustrate both the design and utility of the preferred embodiments of the present invention, in which similar elements in different embodiments are referred to by the same reference numbers for purposes of ease in illustration of the invention, wherein.

DETAILED DESCRIPTION OF THE PREFERRED EMBODIMENTS

Figure 1:
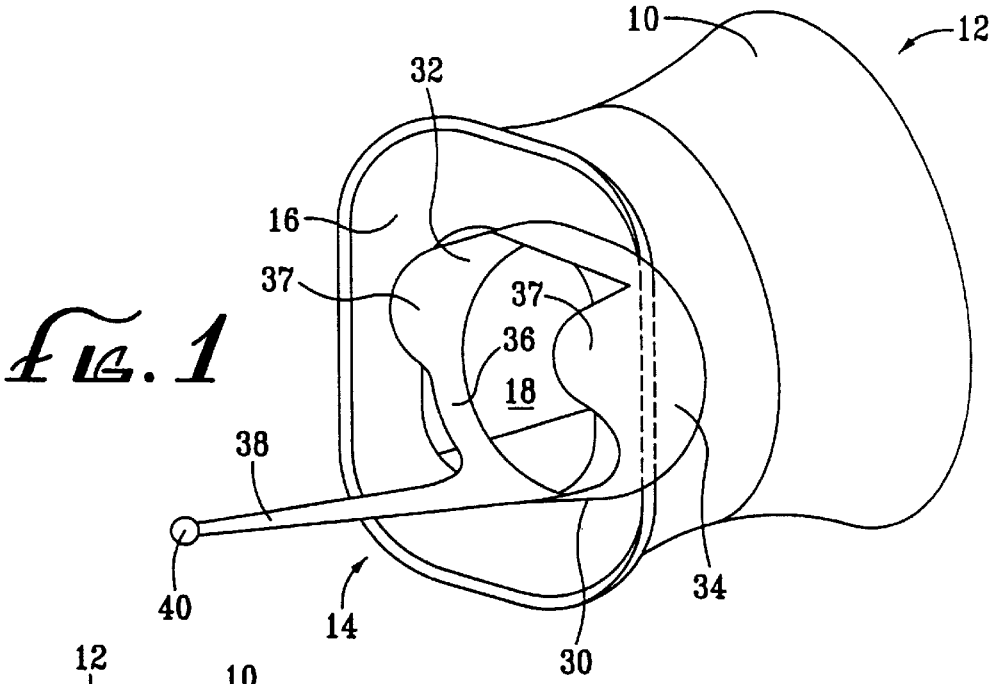
FIG. 1 is a perspective view of a conformal hearing aid tip utilizing a retention and extraction device constructed in accordance with a preferred embodiment of the present invention.
Figure 2:
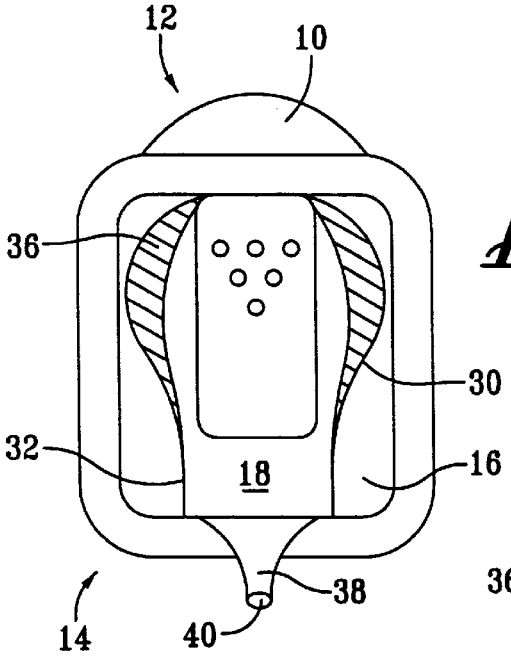
FIG. 2 is a front elevation view of the conformal hearing tip and the retention and extraction device of FIG. 1.
Figure 3:
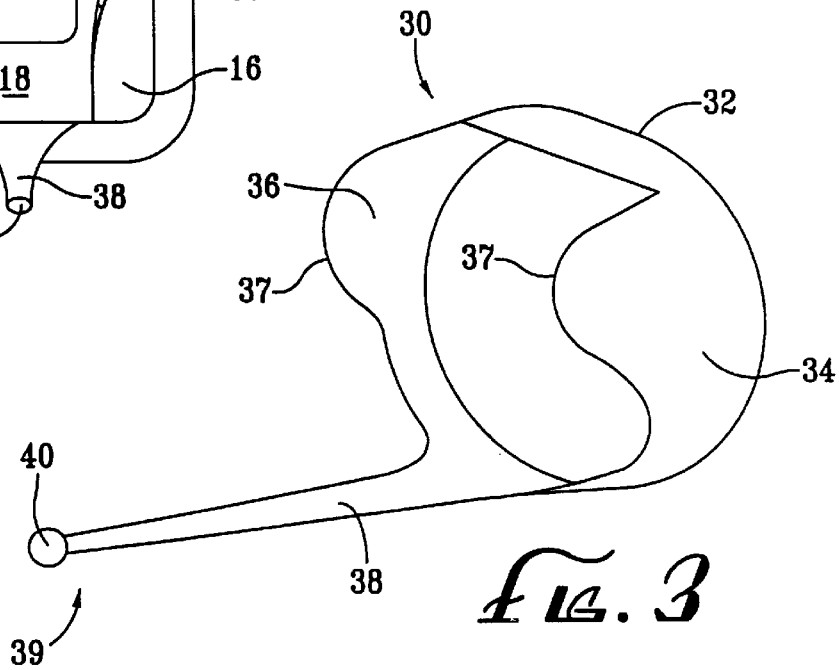
FIG. 3 is a perspective view of the retention and extraction device of FIG. 1.

Referring to FIGS. 1, 2 and 3, FIGS. 1 and 2 show a hearing aid tip 10 utilizing a preferred embodiment of a hearing aid retention and extraction device 30. FIG. 3 shows an isolated perspective view of the hearing aid retention and extraction device 30. The hearing aid tip 10 has a proximal end 12 and a distal end 14. The hearing aid tip 10 forms a sheath that covers the rigid shell of a hearing aid receiver module (not shown). As such, the hearing aid tip 10 has an inner surface 16 that defines a cavity 18. The cavity 18 is open at the distal end 14 of the hearing aid tip 10 and is substantially closed at the proximal end 12 of the hearing aid tip 10. Small apertures 13 are formed into the proximal end of the hearing aid tip, such that sound waves emitted by a receiver module seated within the hearing aid tip 10 will not be obstructed. The apertures 13 also serve as vents that allow pressure equalization between the inner regions of the ear canal and the ambient environment. The apertures 13 can either be utilized by themselves, or they can be made to align with a separate vent tube (not shown) incorporated in a hearing device. The hearing aid tip 10 mounts and acoustically seals a hearing device within the deep bony region of the ear canal, in close proximity to the tympanic membrane.

Preferably, the hearing aid tip is a conformal tip. Preferred examples of conformal hearing aid tips are described in U.S. patent application Ser. No. 09/231,266, entitled "Conformal Tip For A Hearing Aid With Integrated Vent And Retrieval Cord", Ser. No. 09/231,282, entitled "Conformal Tip For A Hearing Aid", Ser. No. 09/161,344, entitled "Conformal In-The-Canal Hearing Device," and U.S. Design patent application Ser. No. 29/109,341, entitled "Conformal Hearing Aid Tip." Each of these applications are hereby incorporated by reference for all they teach and disclose.

The hearing aid retention and extraction device 30 includes a retention ring 32 and an elongate member 38 extending from the retention ring 32. The retention ring 32 is generally annular shaped, however it is not necessary for the retention ring 32 to have two concentric edges, nor is it necessary for the retention ring 32 to have an essentially circular profile. Variations on the exact shape of the retention ring are contemplated by the invention. The retention ring 32 has an outer surface 34 and an inner surface 36. The outer surface 34 of the retention ring 32 is a bonding surface for attaching the retention and extraction device 30 to the inside surface 16 of the hearing aid tip 10. The larger the width of the retention ring 32, the larger the surface area of the outer surface 34 and the stronger the attachment to the hearing aid tip 10 will be. The inner surface 36 of the retention ring 32 is a grasping surface and aids in retaining a hearing device that is inserted into the cavity 18 of the hearing aid tip 10 through the retention ring 32. The inner grasping surface 36 also provides security when a user removes the hearing device from his ear canal and helps prevent the hearing device from becoming separated from the tip.

The retention ring 32 preferably includes at least one side lobe 37. More preferably, there are a pair of opposing side lobes 37, as shown in FIGS. 1–3. The side lobes 37 increase the surface area of the retention ring 32, including both the outer peripheral bonding surface 34, and the inner grasping surface 36. When attached to a hearing aid, the contact area between the outer surface 34 and the inner surface 16 of the hearing aid tip 10 is increased by the presence of the side lobes 37, strengthening the bond between the two surface.

FIG. 1 shows the retention and extraction device 30 attached to the inner surface 16 of the hearing aid tip 10. A glue, epoxy or another type of pliable, resilient and biocompatible adhesive may be used to attach the retention ring 32 to the hearing aid tip 10.

In an alternate embodiment the retention and extraction device 30, and particularly the retention ring 32, may be molded directly into the hearing aid tip 10, wherein the retention ring 32 is integrated into the inner surface 16 of the hearing aid tip 10. While this type of integration helps to reduce manufacturing costs and time, and usually results in a more durable device, it precludes an audiologist or physician from interchanging devices. Since the retention and extraction device 30 can be utilized in a variety of hearing aid tips, it is desirable to be able to independently incorporate the retention and extraction device 30 into a particular hearing aid. As such, a retention and extraction device constructed in accordance with the present invention provides the ability to securely bond or otherwise attach the device 30 to a variety of hearing aid tips. Non permanent adhesives may also be used so that different retention and extraction devices may be interchanged within a single hearing aid tip.

The retention ring 32 is preferably formed from a thin pliable material such as an elastomer, plastic, or other flexible and resilient bio-compatible polymer. When attached to the hearing aid tip 10, the retention ring 32 follows the contours of the inner surface 16 of the hearing aid tip 30. Changes in the shape of the hearing aid tip 30 due to movements of the user, or the varying geometry of an ear canal, are accommodated by the flexible retention ring 32. The peripheral circumference of the retention ring 32 is formatted so that it is slightly smaller than the circumference of the inner surface 16 of the hearing aid tip 10. When bonded or otherwise incorporated into the inner surface 16 of the hearing aid tip, the retention ring 32 slightly cinches the inner surface 16 of the hearing aid tip 10, restricting the size of the cavity 18. Since both the hearing aid tip 10 and the retention ring 32 are made from a flexible and elastic material, the cinched portion of the hearing aid tip will expand to accommodate a larger object that is inserted into the cavity 18 and through the retention ring 32. In particular, the retention ring 32 clasps or grabs onto a hearing device that is inserted into the cavity 18 and through the retention ring 32, as long as the circumference of the hearing aid is larger than the unexpanded circumference of the retainer portion 32.

Extending from the distal edge of the retainer portion 32 is an elongate extraction member 38. The extraction member 38 allows a user to easily and safely remove both a hearing device and a conformal tip from the ear canal. The extraction member 38 enables both components to be removed simultaneously. The extraction member 38 is preferably made from the same material as the retainer portion 32 and can be shaped into a thin ribbon or a cylinder. In a preferred embodiment of the retention and extraction device, the elongate extraction member 38 and the retention ring 32 form a unitary piece. However, it is preferable to make the tensile strength of the extraction member 38 greater than that of the retention ring 32, since a user will be repeatedly pulling on the extraction member in order to remove the hearing device. This can be accomplished by increasing the thickness of the extraction member. The complete retention and extraction device 32 forms a lasso-shape.

Since the extraction member 38 is formed from the same material and is preferably contiguous with the retention ring 32, the entire retention and extraction device 30 can be formed in a single manufacturing operation. A thickening, knob or ridge 40 is formed on the distal end 39 of the extraction member 38 to further aid a user in grasping the extraction member 38. to insert his fingers into the ear canal in order to remove the hearing device, there is also a decreased possibility of damaging the hearing device. In fact, it should not be necessary to touch the hearing device or hearing device tip when using the extraction member.

Figures 4, 5:
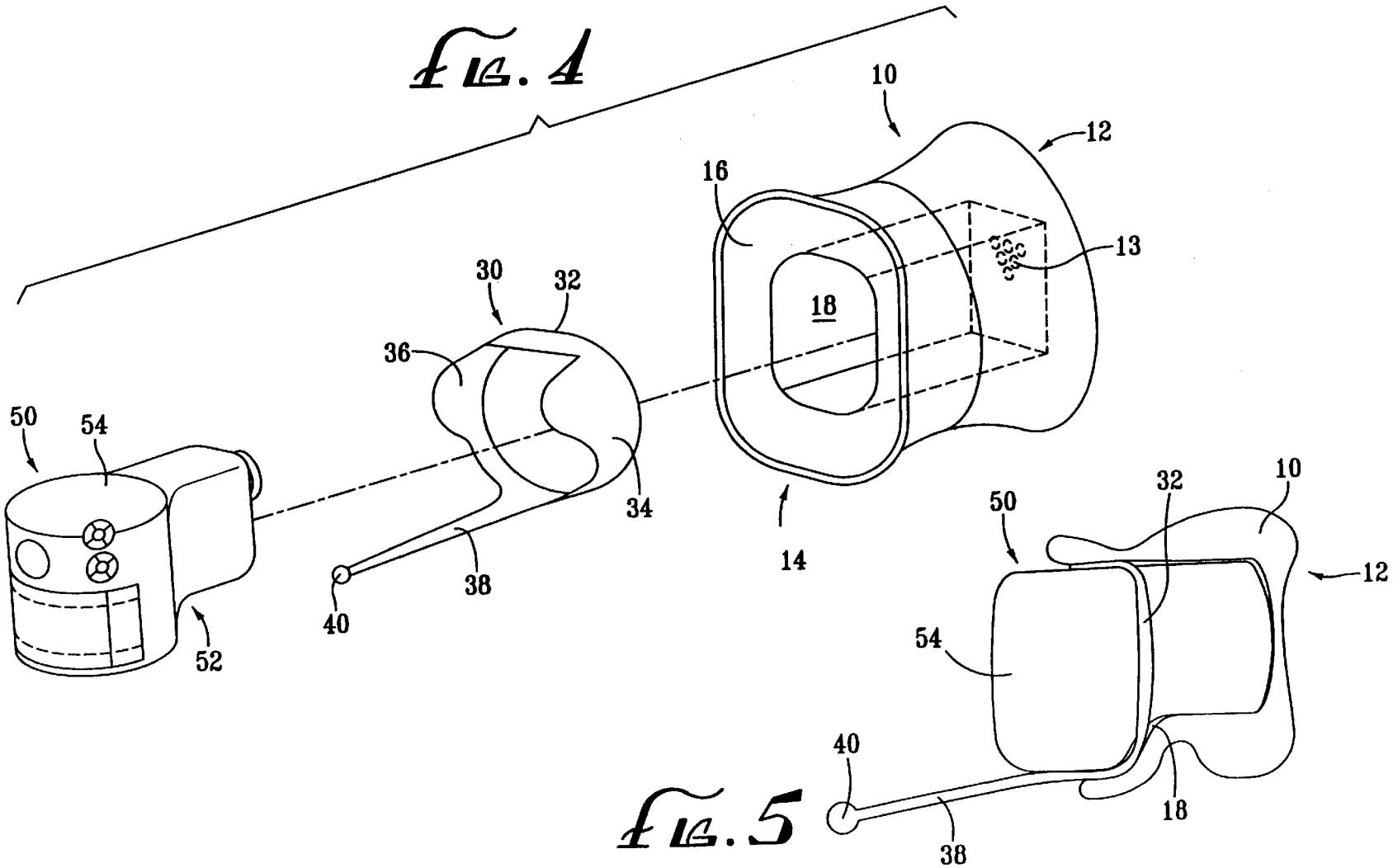
FIG. 4 is an exploded perspective view showing the assembly of a conformal hearing aid tip, a completely in-the-canal hearing device and a retention and extraction device, constructed in accordance with a preferred embodiment of the present invention.
FIG. 5 is a cross sectional view of an assembled conformal hearing aid tip, a completely in-the-canal hearing device, and a retention and extraction device constructed in accordance with a preferred embodiment of the present invention.

FIG. 4 shows an exploded view of an in-the-canal (ITC) hearing device 50, including a retention and extraction device 30 and a conformal hearing aid tip 10, constructed in accordance with a preferred embodiment of the present invention. The ITC device 50 is formed from a hard shelled receiver module 54 and has a tapered shape with a narrow portion 52. The receiver module 54 is inserted into the conformal tip 10 and through the retention ring 32. The retention ring 32 cinches around the narrow portion 52 of the receiver module 54. The retention ring is further cinched around the narrow portion 52, when a user pulls on the extraction member 38, in order to remove the device.

FIG. 5 is a cross section of an assembled ITC device 50, a retention and extraction device 30 constructed in accordance with a preferred embodiment of the present invention, and a conformal hearing aid tip 10. When the receiver module 54 is inserted into the conformal tip 10 and through the retention ring 32, the retention ring 32 surrounds the narrow portion 52 of the receiver module 54. When a user pulls on the extraction member 38, the retention ring 32 cinches around the receiver module 54, and, since the retention ring 32 is bonded to the inner surface 16 of the conformal tip 10, both the ITC device 50 and the device tip 10 are simultaneously extracted from the ear canal without becoming separated.

While preferred embodiments and applications of the present invention have been shown and described, as would be apparent to those skilled in the art, many modifications and applications are possible without departing from the inventive concepts herein. Thus, the scope of the disclosed invention is not to be restricted except in accordance with the appended claims.

What is claimed is:

1. A device for assisting in the retention and extraction of an in-the-canal hearing device, comprising:

a sheath having a proximal end, a distal end, an outside surface, and an inside surface;

a retention ring having a proximal end, a distal end, an outside surface, and an inside surface, wherein the outside surface of the retention ring is attached to the inside surface of the sheath; and an elongate member extending from the distal end of the retention ring.

2. The device of claim 1, wherein the sheath is a conformal sheath.

3. The device of claim 1, wherein the sheath is substantially closed at its proximal end.

4. The device of claim 3, wherein an aperture is formed in the proximal end of the sheath.

5. The device of claim 1, wherein the outside surface of the retention ring substantially conforms to contours of the inside surface of the sheath.

6. The device of claim 1, wherein the outside surface of the retention ring has a circumference smaller than a circumference of the inside surface of the sheath.

7. The device of claim 1, wherein the outside surface of the retention ring cinches the inside surface of the sheath.

8. The device of claim 1, wherein the retention ring is formed from a pliable material.

9. The device of claim 1, wherein the retention ring is molded directly into the sheath.

10. The device of claim 1, wherein the elongate member is made of the same material as the retention ring.

11. The device of claim 10, wherein the elongate member and the retention ring form a unitary piece.

12. The device of claim 1, configured such that movement of the elongate member cinches the inside surface of the sheath.

13. The device of claim 1, further comprising a hearing device inserted into the sheath.

14. The device of claim 13, configured such that the hearing device, sheath, retention ring, and elongate member can be simultaneously removed from an ear canal by movement of the elongate member.

* * * * *

UNITED STATES PATENT AND TRADEMARK OFFICE

CERTIFICATE OF CORRECTION

PATENT NO. : 6,382,346 B1
DATED : May 7, 2002
INVENTOR(S) : Brimhall et al.

It is certified that error appears in the above-identified patent and that said Letters Patent is hereby corrected as shown below:

Title page,
Item [56], References Cited, please add FOREIGN PATENT DOCUMENT
-- WO 95/10567 --

Signed and Sealed this

Seventeenth Day of September, 2002

*Attest:*

*Attesting Officer*

JAMES E. ROGAN
*Director of the United States Patent and Trademark Office*